US011192360B2

(12) United States Patent
Kita

(10) Patent No.: US 11,192,360 B2
(45) Date of Patent: Dec. 7, 2021

(54) LIQUID DISCHARGE HEAD AND RECORDING DEVICE USING SAME

(71) Applicant: KYOCERA Corporation, Kyoto (JP)

(72) Inventor: Hiroyuki Kita, Kirishima (JP)

(73) Assignee: Kyocera Corporation, Kyoto (JP)

( * ) Notice: Subject to any disclaimer, the term of this patent is extended or adjusted under 35 U.S.C. 154(b) by 375 days.

(21) Appl. No.: 16/464,143

(22) PCT Filed: Nov. 24, 2017

(86) PCT No.: PCT/JP2017/042245
§ 371 (c)(1),
(2) Date: May 24, 2019

(87) PCT Pub. No.: WO2018/097255
PCT Pub. Date: May 31, 2018

(65) Prior Publication Data

US 2020/0290345 A1 Sep. 17, 2020

(30) Foreign Application Priority Data

Nov. 25, 2016 (JP) ..... JP2016-229073

(51) Int. Cl.
*B41J 2/045* (2006.01)
*B41J 2/14* (2006.01)
*B41J 2/21* (2006.01)

(52) U.S. Cl.
CPC ..... *B41J 2/04581* (2013.01); *B41J 2/04593* (2013.01); *B41J 2/04595* (2013.01);
(Continued)

(58) Field of Classification Search
CPC ..... B41J 2/04581; B41J 2/04593; B41J 2/04595; B41J 2/14209; B41J 2/2128;
(Continued)

(56) References Cited

U.S. PATENT DOCUMENTS 6,779,866 B2 * 8/2004 Junhua ..... B41J 2/04578 347/19
7,686,407 B2 * 3/2010 Usui ..... B41J 2/2128 347/9

(Continued)

FOREIGN PATENT DOCUMENTS

JP 2000-052570 * 2/2000
JP 2001-293856 A 10/2001

(Continued)

OTHER PUBLICATIONS

Machine translation of JP 2000-052570, published on Feb. 2000 (Year: 2000).*

*Primary Examiner* — Huan H Tran
(74) *Attorney, Agent, or Firm* — Volpe Koenig

(57) ABSTRACT

A liquid discharge head includes a plurality of discharge holes, a plurality of pressurizing units, a plurality of drive circuits, a switch circuit, and first and second control circuits. The drive signals include a first signal for a pixel of a first size and a second drive signal for a pixel of a second size. The second control circuit controls the switch circuit so that each of the plurality of pressurizing units is connected to the drive circuit outputting the first signal when a droplet forming the pixel of the first size is discharged and is connected to the drive circuit outputting the second signal when a droplet forming the pixel of the second size is discharged. The first control circuit controls the drive circuits so that the drive circuits in charge of outputting the first signal is changed among the plurality of drive circuits.

11 Claims, 11 Drawing Sheets

(52) U.S. Cl.
CPC ..... *B41J 2/14209* (2013.01); *B41J 2/2128* (2013.01); *B41J 2002/14419* (2013.01); *B41J 2202/21* (2013.01)

(58) Field of Classification Search
CPC ..... B41J 2002/14419; B41J 2202/21; B41J 2002/14459; B41J 2202/20
See application file for complete search history.

(56) References Cited

U.S. PATENT DOCUMENTS

| | | | | |
|---|---|---|---|---|
| 9,415,587 | B1 * | 8/2016 | Fukazawa | B41J 25/308 |
| 2002/0033852 | A1 | 3/2002 | Chang | |
| 2003/0179256 | A1 * | 9/2003 | Endo | B41J 2/04505 347/19 |
| 2006/0077404 | A1 | 4/2006 | Usui | |
| 2007/0070102 | A1 | 3/2007 | Takata | |
| 2013/0241984 | A1 * | 9/2013 | Akune | B41J 2/04593 347/10 |

FOREIGN PATENT DOCUMENTS

| | | | |
|---|---|---|---|
| JP | 2002-154207 | A | 5/2002 |
| JP | 2007-076116 | A | 3/2007 |
| JP | 2007-090573 | A | 4/2007 |
| JP | 2008-114411 | A | 5/2008 |
| JP | 2010-228241 | A | 10/2010 |
| JP | 2015-076662 | A | 4/2015 |
| JP | 2015-157433 | A | 9/2015 |

* cited by examiner

| | t1 | | t2 | | t3 | | t4 | | t5 | | t6 |
|---|---|---|---|---|---|---|---|---|---|---|---|
| first signal S1 | D1 | → | D2 | → | D3 | → | D4 | → | D5 | → | D1 |
| second signal S2 | D5 | → | D1 | → | D2 | → | D3 | → | D4 | → | D5 |
| third signal S3 | D4 | → | D5 | → | D1 | → | D2 | → | D3 | → | D4 |
| No output | D3 | → | D4 | → | D5 | → | D1 | → | D2 | → | D3 |
| reserve | D2 | → | D3 | → | D4 | → | D5 | → | D1 | → | D2 |

FIG. 7

| | t1 | t2 | t3 | t4 | t5 | t6 |
|---|---|---|---|---|---|---|
| first drive circuit D1 | S1 | S2 | S3 | No output | S2 | S1 |
| second drive circuit D2 | No output | S1 | S2 | S3 | No output | S2 |
| third drive circuit D3 | No output | S1 | S1 | S2 | S3 | No output |
| fourth drive circuit D4 | S3 | No output | S1 | S1 | S2 | S3 |
| fifth drive circuit D5 | S2 | S3 | No output | No output | S1 | S2 |

FIG. 10

LIQUID DISCHARGE HEAD AND RECORDING DEVICE USING SAME

TECHNICAL FIELD

The present disclosure relates to a liquid discharge head and a recording device using the liquid discharge head.

BACKGROUND ART

In the related art, as a liquid discharge head, a known ink jet head performs various types of printing by discharging liquid onto a recording medium. In such a liquid discharge head, a plurality of pressurizing units pressurizes the liquid, and thereby, the liquid is discharged from a plurality of discharge holes disposed corresponding to the respective pressurizing units (see, for example, PTL 1).

CITATION LIST

Patent Literature

PTL 1: Japanese Unexamined Patent Application Publication No. 2002-154207

SUMMARY OF INVENTION

A liquid discharge head according to the present disclosure includes a plurality of discharge holes, a plurality of pressurizing units, a plurality of drive circuits, a switch circuit, a first control circuit, and a second control circuit. The plurality of pressurizing units pressurizes liquid and discharges the liquid from the discharge holes. The drive circuits output drive signals for driving the plurality of pressurizing units. The switch circuit switches connection between the plurality of pressurizing units and the plurality of drive circuits. The first control circuit controls the plurality of drive circuits. The second control circuit controls the switch circuit. The liquid discharge head includes, as the drive signals, a plurality of types of signals including at least a first signal for discharging a droplet forming a pixel of a first size and a second signal for discharging a droplet forming a pixel of a second size different from the first size. The first control circuit controls the plurality of drive circuits to output different types of the drive signals from different drive circuits among the plurality of drive circuits. The second control circuit controls the switch circuit to cause each of the plurality of pressurizing units to be connected to the drive circuit outputting the first signal when the droplet forming the pixel of the first size is discharged and to be connected to the drive circuit outputting the second signal when the droplet forming the pixel of the second size is discharged. The first control circuit controls the plurality of drive circuits to cause the drive circuit in charge of outputting the first signal to be changed among the plurality of drive circuits.

A recording device according to the present disclosure includes the liquid discharge head, and a transport unit that transports a recording medium with respect to the liquid discharge head.

BRIEF DESCRIPTION OF DRAWINGS

FIG. 7 is a diagram illustrating an example of rotation of drive circuits in the liquid discharge head according to the present disclosure.

FIG. 10 is a diagram illustrating signals output by the respective drive circuits at each time when rotation of the drive circuits illustrated in FIG. 7 is performed.

DESCRIPTION OF EMBODIMENTS

In the ink jet head as described in PTL 1, drive signals for driving the pressurizing units are generated and the respective pressurizing units are driven by sending the drive signals to the pressurizing units. However, in an ink jet head discharging liquid from multiple discharge holes at the same time, since it is necessary to send drive signals to the multiple pressurizing units at the same time, there is a problem of heat generation or an increase in the size of a circuit (in particular, a power amplifier in the circuit) for generating the drive signal.

In order to solve such problems, it is conceivable that a plurality of different types of drive signals is generated by different circuits according to the size of a pixel (for example, small pixel, middle pixel, or large pixel) on a recording medium. However, when the plurality of different types of drive signals is generated by different circuits, the amount of heat generated by the circuits generating respective drive signals is different depending on the number of pressurizing units to which respective drive signals are sent (for example, when printing a solid pattern, the number of pressurizing units to which drive signals corresponding to large pixels are sent is significantly increased, and the amount of heat generated by the circuit generating the drive signals corresponding to large pixels is significantly increased). Accordingly, if a state in which there is a difference in the amount of heat generated from the circuits that generate respective drive signals continues for a certain period of time, a problem that temperature of a specific circuit rises excessively and causes malfunction or a problem that accuracy in discharging liquid is deteriorated as the difference in temperature depending on the location of the liquid discharge head becomes large occurs.

The liquid discharge head according to the present disclosure can reduce excessive temperature rise of a specific circuit, and can reduce temperature difference between a plurality of circuits. With this configuration, occurrence of the malfunction of the circuit due to temperature rise can be reduced. Depending on the disposition of the drive circuits on the liquid discharge head, it is possible to reduce deterioration of the discharge accuracy due to an increase of the temperature difference depending on the location of the liquid discharge head. Hereinafter, the liquid discharge head according to the present disclosure and a recording device using the liquid discharge head will be described in detail.

Figure 1A:
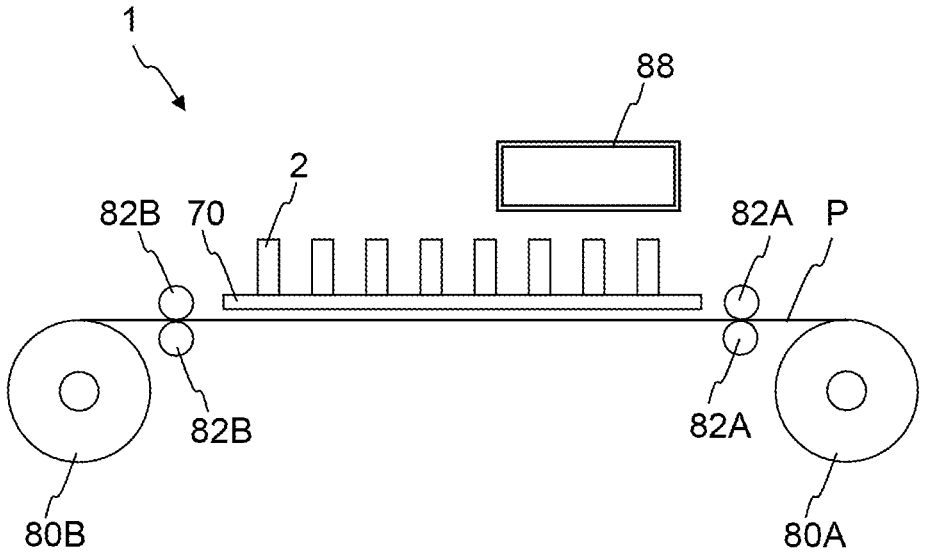
FIG. 1A is a side view schematically illustrating an example of a configuration of a recording device including a liquid discharge head according to the present disclosure.
Figure 1B:
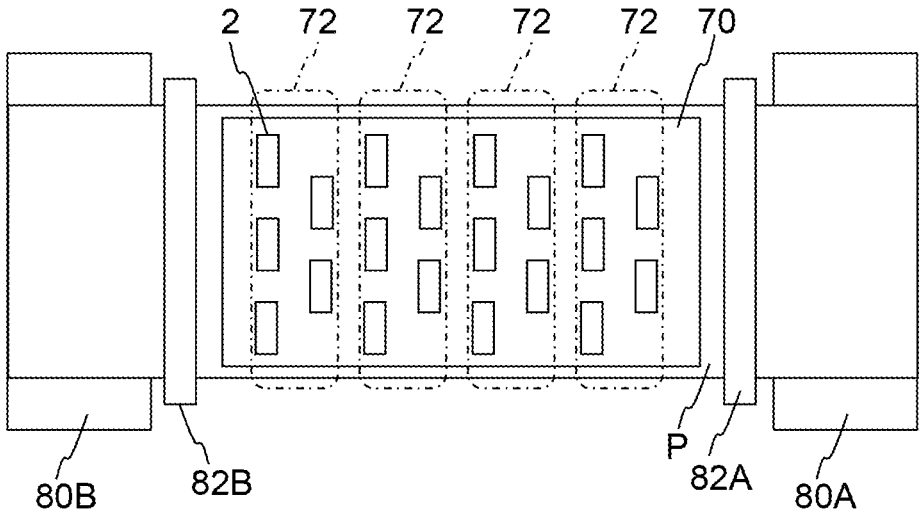
FIG. 1B is a plan view schematically illustrating an example of the configuration of the recording device including the liquid discharge head according to the present disclosure.

FIGS. 1A and 1B are schematic views of a color ink jet printer 1 (hereinafter, may be simply referred to as a printer) which is an example of a recording device including a liquid discharge head according to the present disclosure. FIG. 1A is a side view and FIG. 1B is a plan view. The printer 1 moves printing paper P relative to a liquid discharge head 2 by transporting the printing paper P, which is a recording medium, from a guide roller 82A to a transport roller 82B. Then, the printer 1 controls the liquid discharge head 2 by a control unit 88 to discharge liquid from the liquid discharge head 2 based on data of an image and a character, and causes a droplet to land on the printing paper P. Thus, the printer 1 performs recording such as printing on the printing paper P.

In this example, the liquid discharge head 2 is fixed to the printer 1 and the printer 1 is a so-called line printer, but is not limited thereto. For example, the printer 1 may also be a so-called serial printer that alternately performs an operation to move the printing paper P by reciprocating the liquid discharge head 2 back and forth in a direction crossing a transport direction of the printing paper P, for example, in a direction substantially orthogonal thereto and transportation of the printing paper P.

In the printer 1, a flat plate-like head mounting frame (hereinafter, may be simply referred to as a frame) is fixed so as to be substantially parallel to the printing paper P. The frame 70 is provided with 20 holes (not illustrated), and twenty liquid discharge heads 2 are mounted in the respective holes, and a part of the liquid discharge head 2 from which liquid is discharged faces the printing paper P. The distance between the liquid discharge head 2 and the printing paper P is, for example, about 0.5 to 20 mm. In FIG. 1, an example in which one head group 72 is configured by five liquid discharge heads 2 among twenty liquid discharge heads 2 and the printer 1 includes four head groups 72 is illustrated.

The liquid discharge head 2 has an elongated shape long and thin in a direction from the front toward the back of FIGS. 1A and 1*n* the top-bottom direction of FIG. 1B. This long direction may be called the longitudinal direction. In one head group 72, three liquid discharge heads 2 are arranged along a direction crossing the transport direction of the printing paper P, for example, a direction substantially orthogonal to the transport direction. The other two liquid discharge heads 2 are arranged one by one between the three liquid discharge heads 2 at positions shifted along the transport direction. The liquid discharge heads 2 are disposed so that a printable range by each liquid discharge head 2 is connected in a width direction of the printing paper P (in the direction crossing the transport direction of the printing paper P) or edges of the printable range overlap, and printing without gaps in the width direction of the printing paper P is possible.

Four head groups 72 are disposed along the transport direction of the printing paper P. Liquid, for example, ink is supplied to each liquid discharge head 2 from a liquid tank (not illustrated). Ink of the same color is supplied to the liquid discharge heads 2 belonging to one head group 72, and four colors of ink can be printed by four head groups 72. The colors of the ink discharged from respective head groups 72 are, for example, magenta (M), yellow (Y), cyan (C), and black (K). If such ink is controlled by the control unit 88 and printed, a color image can be printed.

When single-color printing is performed and a printable range is printed with one liquid discharge head 2, the number of the liquid discharge heads 2 mounted on the printer 1 may be one. The number of liquid discharge heads 2 included in the head group 72 and the number of head groups 72 can be appropriately changed according to a target to be printed and a printing condition. For example, the number of head groups 72 may be increased to print more colors. Further, when printing is alternately made in the transport direction by arranging a plurality of head groups 72 printing in the same color, even if the liquid discharge head 2 having the same performance is used, a transport speed can be increased. With this configuration, it is possible to increase a printing area per hour. A plurality of head groups 72 printing the same color may be prepared and disposed to be shifted in the direction crossing the transport direction to thereby increasing resolution in the width direction of the printing paper P.

Furthermore, liquid such as a coating agent may be printed in order to perform surface treatment of the printing paper P, in addition to printing colored ink.

The printer 1 performs printing on the printing paper P, which is a recording medium. The printing paper P is in a state of being wound around a paper feed roller 80A, passes under the liquid discharge head 2 mounted on the frame 70 after passing between two guide rollers 82A, and then, passes between two transport rollers 82B, and is finally collected by a recovery roller 80B. At the time of printing, the printing paper P is transported at a constant speed by rotating the transport roller 82B and printed by the liquid discharge head 2. The recovery roller 80B winds up the printing paper P sent out from the transport roller 82B. As such, a transport unit transporting the printing paper P with respect to the liquid discharge head 2 is configured by the paper feed roller 80A, the guide roller 82A, the transport roller 82B, and the recovery roller 80B. The transport speed is, for example, 75 m/minute. Each roller may be controlled by the control unit 88 or manually operated by a person.

The recording medium may be a roll-like cloth or the like, instead of the printing paper P. Instead of directly transporting the printing paper P, the printer 1 may directly transport the transport belt on which the recording medium is placed. In such a case, a sheet, a cut cloth, a wood, a tile or the like can be used as a recording medium. Furthermore, the liquid discharge head 2 may discharge liquid containing conductive particles to print a wiring pattern of an electronic device or the like. Furthermore, the pharmaceutical products may be produced by causing a predetermined amount of liquid chemical agent or liquid containing the chemical agent to be discharged from the liquid discharge head 2 to a reaction container or the like and causing the liquid chemical agent or the liquid to react.

A position sensor, a speed sensor, a temperature sensor, and the like may be attached to the printer 1, and the control unit 88 may control each part of the printer 1 according to a state of each part of the printer 1 known based on information from each sensor. For example, when the temperature of the liquid discharge head 2, temperature of liquid in the liquid tank, pressure applied by the liquid in the liquid tank to the liquid discharge head 2 or the like affect discharge characteristics such as a discharge amount and discharge speed of discharged liquid, and the like, the drive signal for discharging the liquid may be changed according to the information.

The recording device in the present disclosure may include the liquid discharge head and the transport unit transporting the recording medium with respect to the liquid discharge head, and other configurations thereof are not limited at all. Further, the configuration of the transport unit is also not limited to the configuration illustrated in this embodiment.

Figure 2:
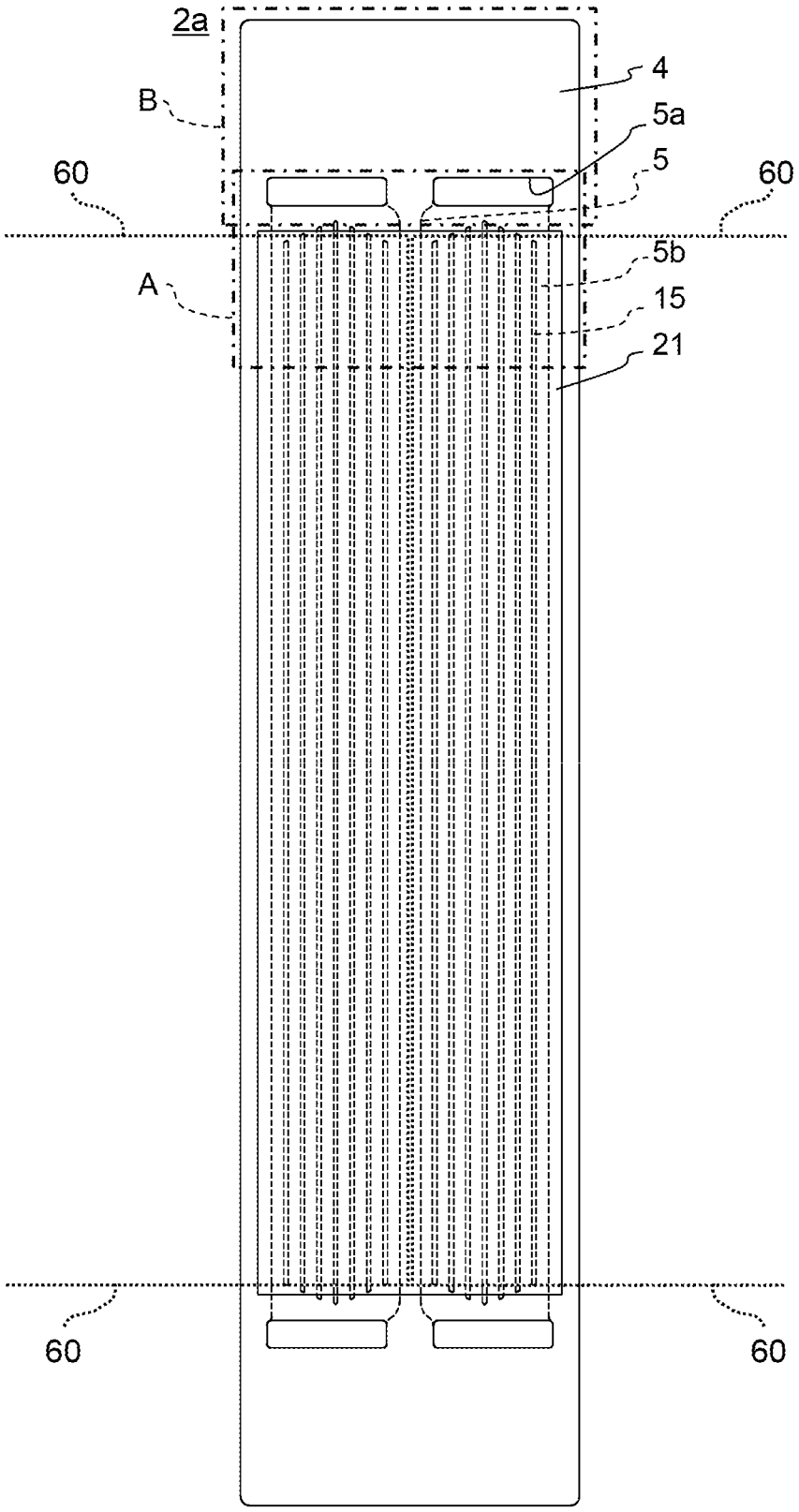
FIG. 2 is a plan view of a head main body which is a principal part of the liquid discharge head of FIG. 1.
Figure 3:
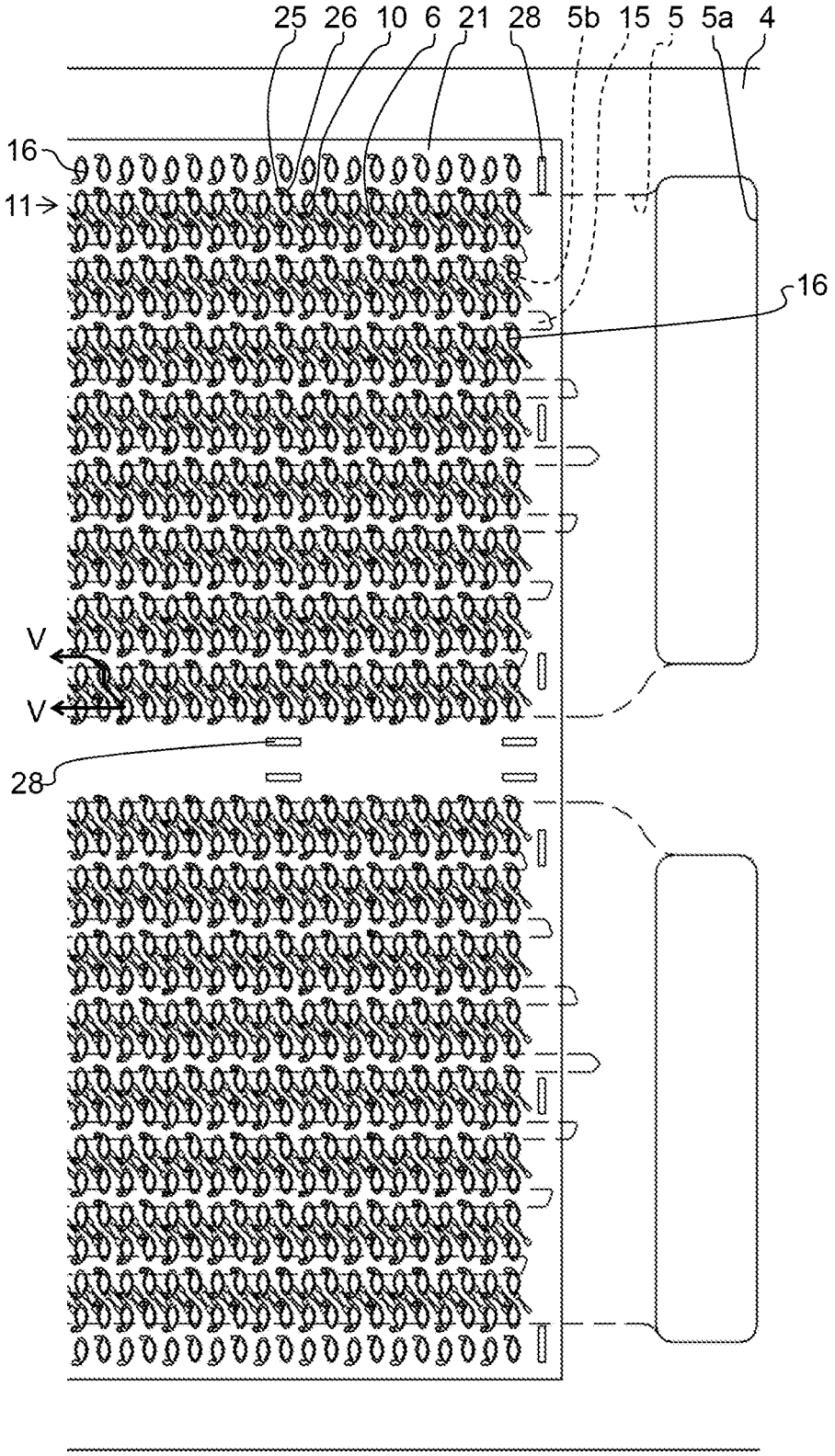
FIG. 3 is an enlarged view of a region A surrounded by one dot chain line in FIG. 2, in which a part of flow paths is omitted for explanation.
Figure 4:
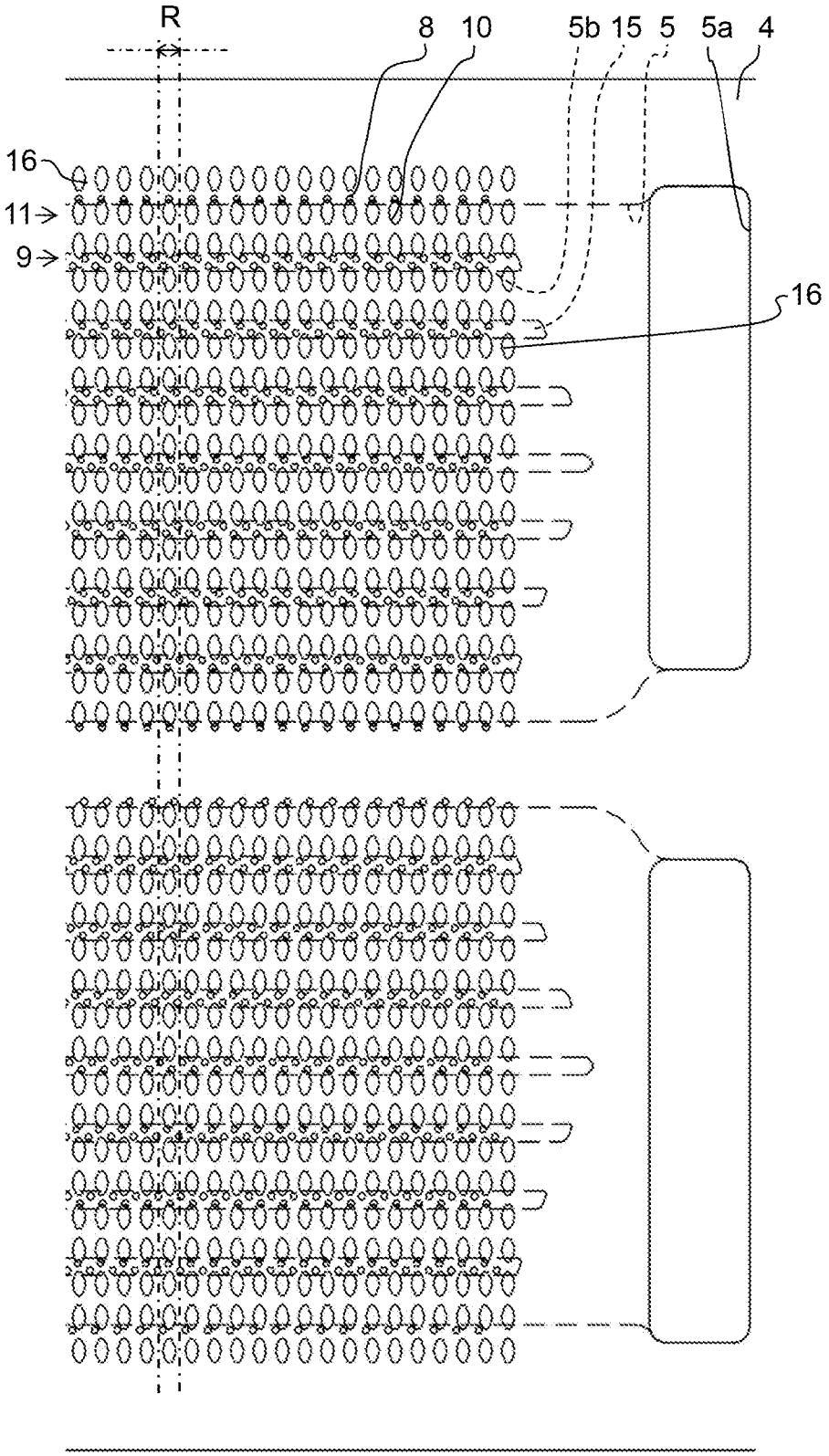
FIG. 4 is an enlarged view of the region A surrounded by one dot chain line in FIG. 2, in which a part of the flow paths is omitted for explanation.
Figure 5:
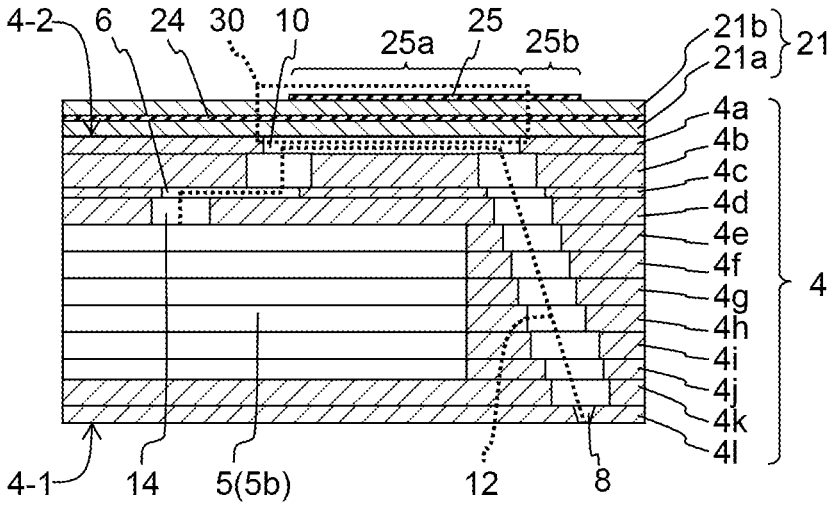
FIG. 5 is a longitudinal sectional view taken along line V-V of FIG. 3.

Next, an example of the configuration of the liquid discharge head according to the present disclosure will be described. FIG. 2 is a plan view illustrating a head main body 2*a* which is a main part of the liquid discharge head 2 illustrated in FIG. 1. FIG. 3 is an enlarged plan view of a region surrounded by one dot chain line in FIG. 2, which is a part of the head main body 2*a*. In FIG. 3, illustration is made by omitting some flow paths for explanation. FIG. 4 is an enlarged plan view of the same position as FIG. 3, and illustration is made by omitting some flow paths different from those of FIG. 3. FIG. 5 is a longitudinal sectional view taken along the line V-V of FIG. 3. In FIG. 3 and FIG. 4, in order to make the drawings easy to understand, pressurizing chambers 10, diaphragms 6, discharge holes 8 and the like are drawn by solid lines instead of broken lines to be used for drawing those located below a piezoelectric actuator substrate 21.

The liquid discharge head 2 may include a reservoir for supplying liquid to the head main body 2*a* and a casing, in addition to the head main body 2*a*. The head main body 2*a* also includes a flow path member 4 and the piezoelectric actuator substrate 21 including the pressurizing unit 30.

The flow path member 4 configuring the head main body 2*a* includes a manifold 5 which is a common flow path, a plurality of pressurizing chambers 10 connected to the manifold 5, and a plurality of discharge holes 8 connected to the plurality of pressurizing chambers 10. The pressurizing chamber 10 is opened to the top surface of the flow path member 4, and the top surface of the flow path member 4 is a pressurizing chamber surface 4-2. The top surface of the flow path member 4 has an opening 5*a* connected to the manifold 5, and liquid is supplied from the opening 5*a*.

The piezoelectric actuator substrate 21 including the pressurizing unit 30 is joined to the top surface of the flow path member 4, and the respective pressurizing units 30 are disposed above the pressurizing chamber 10. A signal transfer unit 60 that supplies a signal to each pressurizing unit 30 is connected to the piezoelectric actuator substrate 21. In FIG. 2, the outline of the vicinity of the signal transfer unit 60 connected to the piezoelectric actuator substrate 21 is illustrated by a dotted line so that a state in which two signal transfer units 60 are connected to the piezoelectric actuator substrate 21 can be understood. Electrodes formed on the signal transfer unit 60 and electrically connected to the piezoelectric actuator substrate 21 are disposed in a rectangular shape at an end portion of the signal transfer unit 60. Two signal transfer units 60 are connected such that respective ends of the two signal transfer units 60 are at the central portion in the lateral direction of the piezoelectric actuator substrate 21.

The head main body 2*a* includes one flat plate-like flow path member 4 and one piezoelectric actuator substrate 21 including the pressurizing unit 30 joined on the flow path member 4. The shape of the piezoelectric actuator substrate 21 is a rectangle in plan view, and the long side of the rectangle is disposed on the top surface of the flow path member 4 so as to be along the longitudinal direction of the flow path member 4.

The flow path member 4 includes two manifolds 5. The manifold 5 has an elongated shape extending from one end portion to the other end portion in the longitudinal direction of the flow path member 4, and the opening 5*a* of the manifold 5 opened to the top surface of the flow path member 4 are formed at both end portions of the manifold 5.

The manifold 5 is partitioned at least at a central portion, which is a region connected to the pressurizing chambers 10 in the longitudinal direction, by partition walls 15 disposed at an interval in the lateral direction. The partition walls 15 have the same height as the manifold 5 in the central portion, which is a region connected to the pressurizing chamber 10, in the longitudinal direction and completely divide the manifold 5 into a plurality of portions. In this way, it is possible to provide the discharge holes 8 and the flow path connected to the pressurizing chambers 10 from the discharge holes 8 so as to overlap the partition walls 15 in a plan view.

The manifold 5 divided into the plurality of portions may be called a sub-manifold 5*b*. In this embodiment, two manifolds 5 are disposed independently, and the openings 5*a* are disposed at both ends of each manifold 5. Seven partition walls 15 are disposed in one manifold 5 and one manifold 5 is divided into eight sub-manifolds 5*b*. The width of the sub-manifold 5*b* is larger than the width of the partition wall 15, so that a large amount of liquid can flow through the sub-manifold 5*b*.

The flow path member 4 is formed by a plurality of pressurizing chambers 10 disposed two-dimensionally. The pressurizing chamber 10 is a hollow region having a substantially rhombic or elliptical shape in plan view applied with rounded corners.

The pressurizing chamber 10 is connected to one sub-manifold 5*b* through the diaphragm 6. A total of two pressurizing chamber rows 11, which are rows of pressurizing chambers 10 connected to the sub-manifold 5*b*, are disposed along the one sub-manifold 5*b* so that one row is on each side of the sub-manifold 5*b*. Accordingly, sixteen pressurizing chamber rows 11 are disposed for one manifold 5, and thirty-two pressurizing chamber rows 11 are disposed in the entire head main body 2*a*. The intervals in the longitudinal direction of the pressurizing chambers 10 in each pressurizing chamber row 11 are the same, for example, an interval of 37.5 dpi.

One column of dummy pressurizing chambers 16 is disposed at an end of each pressurizing chamber row 11. The dummy pressurizing chambers 16 in this dummy pressurizing chamber column are connected to the manifold 5 but not connected to the discharge holes 8. One dummy pressurizing chamber row in which the dummy pressurizing chambers 16 are linearly arranged is disposed outside the thirty-two pressurizing chamber rows 11. The dummy pressurizing chambers 16 in the dummy pressurizing chamber row are not connected to either the manifold 5 or the discharge holes 8. These dummy pressurizing chambers 16 make a structure (stiffness) around the pressurizing chambers 10 one inner side from the end close to a structure (stiffness) of the other pressurizing chambers 10, thereby capable of reducing the difference in liquid discharge characteristics. Since the influence of the difference of the surrounding structure has a large influence of the pressurizing chamber 10 adjacent to each other in the length direction with a short distance, the dummy pressurizing chambers are disposed at both ends in the length direction. In the width direction, since the influence is relatively small, the dummy pressurizing chambers are disposed only in the direction closer to the end of the head main body 21*a*. With this configuration, the width of the head main body 21*a* can be reduced.

The pressurizing chambers 10 connected to one manifold 5 are disposed in a grid form of rows and columns along the outer sides of the rectangular piezoelectric actuator substrate 21. With this configuration, since the individual electrodes 25 on the pressurizing chamber 10 are disposed equidistantly from the outer side of the piezoelectric actuator substrate 21, deformation of the piezoelectric actuator substrate 21 is less likely to occur when the individual electrodes 25 are formed. When the piezoelectric actuator substrate 21 and the flow path member 4 are joined, if this deformation is large, there is a concern that stress is applied to the pressurizing unit 30 close to the outer side and displacement characteristics may vary, but the variation can be reduced by reducing the deformation. Since the dummy pressurizing chamber row of the dummy pressurizing chambers 16 is on the outside of the pressurizing chamber row 11 closest to the outer side, the influence of deformation can be made more difficult. The pressurizing chambers 10 belonging to the pressurizing chamber row 11 are disposed at equal intervals, and the individual electrodes 25 corresponding to the pressurizing chamber row 11 are also disposed at equal intervals. The pressurizing chamber rows 11 are disposed at equal intervals in the lateral direction, and the rows of the individual electrodes 25 corresponding to the pressurizing chamber rows 11 are also disposed at equal intervals in the lateral direction. With this configuration, it is possible to eliminate a portion where the influence of the crosstalk is particularly large.

In this embodiment, the pressurizing chambers 10 are disposed in a grid, but may be disposed in a staggered manner so that the pressurizing chambers 10 of the adjacent pressurizing chamber rows 11 are positioned between each other. In this way, since the distance between the pressurizing chambers 10 belonging to the adjacent pressurizing chamber rows 11 is longer, crosstalk can be further suppressed.

Regardless of how the pressurizing chamber rows 11 are arranged, crosstalk can be suppressed by disposing the pressurizing chambers 10 belonging to one pressurizing chamber row 11 so as not to overlap the pressurizing chambers 10 belonging to the adjacent pressurizing chamber rows 11 in the longitudinal direction of the liquid discharge head 2 when the flow path member 4 is viewed in a plan view. On the other hand, when the distance between the pressurizing chamber rows 11 is increased, the width of the liquid discharge head 2 is increased. Therefore, the influence of accuracy of an installation angle of the liquid discharge head 2 with respect to the printer 1 and accuracy of the relative position of the liquid discharge head 2 when using a plurality of liquid discharge heads 2 on a printing result becomes large. Accordingly, it is possible to reduce the influence of the accuracy on the printing result by making the width of the partition wall 15 smaller than that of the sub-manifold 5*b*.

The pressurizing chambers 10 connected to one sub-manifold 5*b* form two columns of pressurizing chamber rows 11, and the discharge holes 8 connected from the pressurizing chambers 10 belonging to one pressurizing chamber row 11 form one discharge hole row 9. The discharge holes 8 connected to the pressurizing chambers 10 belonging to the two rows of pressurizing chamber row 11 respectively open to different sides of the sub-manifold 5*b*. In FIG. 4, two rows of the discharge hole row 9 are disposed in the partition wall 15, but the discharge holes 8 belonging to each discharge hole row 9 are connected to the sub-manifold 5*b* closer to the discharge holes 8 through the pressurizing chambers 10.

When the discharge holes 8 connected to the adjacent sub-manifold 5*b* through the pressurizing chamber row 11 and the liquid discharge head 2 are disposed so as not to overlap in the longitudinal direction, since crosstalk between the flow paths connecting the pressurizing chamber 10 and the discharge hole 8 can be suppressed, crosstalk can be further reduced. When the entire flow path connecting the pressurizing chambers 10 and the discharge holes 8 are disposed so as not to overlap in the longitudinal direction of the liquid discharge head 2, crosstalk can be further reduced.

Since a pressurizing chamber group is configured by a plurality of pressurizing chambers 10 connected to one manifold and there are two manifolds 5, there are two pressurizing chamber groups. The disposition of the pressurizing chambers 10 related to discharge in each pressurizing chamber group is the same, and the pressurizing chambers 10 are disposed at positions translated parallel to the lateral direction. These pressurizing chambers 10 are arranged over almost the entire surface although there is a portion where the distance between the pressurizing chamber groups is slightly increased in the region facing the piezoelectric actuator substrate 21 on the top surface of the flow path member 4. That is, the pressurizing chamber group formed by these pressurizing chambers 10 occupies a region having substantially the same shape as the piezoelectric actuator substrate 21. The opening of each pressurizing chamber is closed by the piezoelectric actuator substrate 21 being joined to the top surface of the flow path member 4.

A flow path connected to the discharge holes 8 opened to a discharge hole surface 4-1 of the back surface of the flow path member 4 extends from the corner portion facing the corner portion to which the diaphragm 6 of the pressurizing chamber 10 is connected. The flow path extends in a direction away from the pressurizing chamber 10 in a plan view. More specifically, while being separated in the direction along the long diagonal of the pressurizing chamber 10, the flow path extends while being shifted to the left and right with respect to that direction. With this configuration, the discharge holes 8 can be disposed at an interval of 1200 dpi as a whole, while the pressurizing chambers 10 are disposed in a grid form with an interval of 37.5 dpi in each pressurizing chamber row 11.

In other words, when the discharge holes 8 are projected so as to be orthogonal to an imaginary straight line parallel to the longitudinal direction of the flow path member 4, sixteen discharge holes 8 connected to each manifold 5, that is, thirty-two discharge holes 8 in total are disposed at equal intervals of 1200 dpi, in the range of R of the imaginary straight line illustrated in FIG. 4. With this configuration, it is possible to form an image with resolution of 1200 dpi in the longitudinal direction as a whole, by supplying the ink of the same color to all the manifolds 5. One discharge hole 8 connected to one manifold 5 are disposed at equal intervals of 600 dpi in the range of R of the imaginary straight line. With this configuration, it is possible to form an image of two colors with resolution of 600 dpi in the longitudinal direction as a whole, by supplying inks of different colors to respective manifolds 5. In this case, if two liquid discharge heads 2 are used, four color images can be formed with the resolution of 600 dpi, and printing accuracy is higher and printing settings can be simplified than using four liquid discharge heads printable at 600 dpi. The range R of the virtual straight line is covered by the discharge holes 8 connected from the pressurizing chambers 10 belonging to one row of pressurizing chambers arranged in the lateral direction of the head main body 2*a*.

Individual electrodes 25 are respectively formed at positions facing the pressurizing chambers 10 on the top surface of the piezoelectric actuator substrate 21. Each of the individual electrodes 25 includes an individual electrode main body 25*a* slightly smaller than the pressurizing chamber 10 and having a shape substantially similar to that of the pressurizing chamber 10, and an extraction electrode 25*b* drawn from the individual electrode main body 25*a*. The individual electrodes 25 constitute an individual electrode array and an individual electrode group in the same manner as the pressurizing chamber 10. Surface electrodes 28 for the common electrode are disposed on the top surface of the piezoelectric actuator substrate 21. The surface electrodes 28 for the common electrode and the common electrode 24 are electrically connected to each other through a through conductor (not illustrated) disposed in a piezoelectric ceramic layer 21*b*.

The discharge holes 8 are disposed at a position avoiding a region facing the manifold 5 disposed on a portion in the vicinity of the back surface of the flow path member 4. Furthermore, the discharge holes 8 are disposed in the region on the portion in the vicinity of the back surface of the flow path member 4 facing the piezoelectric actuator substrate 21. These discharge holes 8 occupy a region having substantially the same shape as the piezoelectric actuator substrate 21 as one group, and can discharge droplets from the discharge holes 8 by displacing the pressurizing units 30 of the corresponding piezoelectric actuator substrate 21.

The flow path member 4 included in the head main body 2*a* has a multilayer structure in which a plurality of plates is stacked via an adhesive layer. These plates are a cavity plate 4*a*, an aperture (diaphragm) plate 4*b*, a supply plate 4*c*, manifold plates 4*d* to 4*i*, a cover plate 4*j*, and a nozzle plate 4*l* in this order from the top surface of the flow path member 4. Many holes are formed in these plates. Formation accuracy of the holes can be increased by setting the thickness of each plate to about 10 μm to 300 μm. The thickness of the flow path member 4 is about 500 μm to 2 mm. The plates are aligned and stacked so that the holes communicate with one another to configure individual flow paths 12 and manifolds 5. The head main body 2*a* has a configuration in which the pressurizing chambers 10 are on the top surface of the flow path member 4, the manifold 5 is on the portion in the vicinity of the back surface inside thereof, the discharge holes 8 are arranged on the back surface and in close proximity to each other at different positions constituting the individual flow paths 12, and the manifold 5 and the discharge holes 8 are connected through the pressurizing chambers 10.

The holes and grooves disposed in each plate will be described. The holes or grooves that become the flow paths are as follows. First, as a first partial flow path, there are holes constituting the pressurizing chamber 10 in the cavity plate 4*a*. Next, as a second partial flow path, there are communication holes constituting the diaphragm 6 connected from one end of the pressurizing chamber 10 to the manifold 5. The communication holes are formed in each plate from the aperture plate 4*b* (specifically, the inlet of the pressurizing chamber 10) to the supply plate 4*c* (specifically, the outlet of the manifold 5).

Next, as a third partial flow path, there are communication holes constituting a descender 7 which is a flow path communicating with the discharge hole 8 from the other end opposite to the end of the pressurizing chamber 10 to which the diaphragm 6 is connected. The communication hole is formed in each plate from the base plate 4*b* (specifically, the outlet of the pressurizing chamber 10) to the nozzle plate 4*l* (specifically, the discharge hole 8).

Next, as a fourth partial flow path, there are communication holes constituting the sub-manifold 5*a*. The communication holes are formed in the manifold plates 4*c* to 4*i*. Holes are formed in the manifold plates 4*c* to 4*i* so that partition portions to be the partition walls 15 remain so as to constitute the sub-manifold 5*b*. Partition portions in the manifold plates 4*c* to 4*i* are in a state of being connected to the manifold plates 4*c* to 4*i* by half-etched supports (not illustrated in the figure).

Such first to fourth partial flow paths are connected to each other to constitute the individual flow path 12 from an inflow port of liquid from the manifold 5 (the outlet of the manifold 5) to the discharge hole 8. Liquid supplied to the manifold 5 is discharged from the discharge hole 8 through the following path. First, the liquid goes up from the manifold 5 and reaches one end of the diaphragm 6. Next, the liquid advances horizontally along an extending direction of the diaphragm 6 and reaches the other end of the diaphragm 6. From there, the liquid goes up and reaches one end of the pressurizing chamber 10. Furthermore, the liquid horizontally advances along the extending direction of the pressurizing chamber 10 and reaches the other end of the pressurizing chamber 10. The liquid that has entered the descender 7 from the pressurizing chamber 10 is also moved in the horizontal direction, mainly goes downward and reaches the discharge hole 8 opened to the back surface, and is discharged to the outside.

The piezoelectric actuator substrate 21 has a multilayer structure composed of two piezoelectric ceramic layers 21*a* and 21*b* which are piezoelectric bodies. Each of the piezoelectric ceramic layers 21*a* and 21*b* has a thickness of about 20 μm. The thickness from the back surface of the piezoelectric ceramic layer 21*a* of the piezoelectric actuator substrate 21 to the top surface of the piezoelectric ceramic layer 21*b* is about 40 μm. Each of the piezoelectric ceramic layers 21*a* and 21*b* extends so as to straddle the plurality of pressurizing chambers 10. These piezoelectric ceramic layers 21*a* and 21*b* are made of, for example, a lead zirconate titanate (PZT)-based, $NaNbO_3$-based, $BaTiO_3$-based, (BiNa) $NbO_3$-based, or $BiNaNb_5O_{15}$-based ceramic material having ferroelectricity. The piezoelectric ceramic layer 21*a* does not function as a piezoelectric element but functions as a simple elastic plate. For that reason, another ceramic layer or a metal plate which is not a piezoelectric body may be used, instead of the piezoelectric ceramic layer 21*a*.

The piezoelectric actuator substrate 21 includes the common electrode 24 made of, for example, a Ag—Pd based metal material and the individual electrodes 25 made of, for example, an Au-based metal material. The thickness of the common electrode 24 is about 2 μm, and the thickness of the individual electrode 25 is about 1 μm.

The individual electrodes 25 are respectively disposed at positions facing the pressurizing chambers 10 on the top surface of the piezoelectric actuator substrate 21. The individual electrode 25 includes the individual electrode main body 25*a*, which is slightly smaller in a plan view than the pressurizing chamber main body 10*a* and has a shape substantially similar to the pressurizing chamber main body 10*a*, and an extraction electrode 25*b* drawn from the individual electrode main body 25*a*. The connection electrode 26 is disposed at a part of one end of the extraction electrode

25*b* drawn out of the region facing the pressurizing chamber 10. The connection electrode 26 is, for example, a conductive resin containing conductive particles such as silver particles, and is formed with a thickness of about 5 μm to 200 μm. The connection electrode 26 is electrically joined to an electrode disposed in the signal transfer unit 60.

Although details will be described later, the drive signal is supplied to the individual electrodes 25 through the signal transfer unit 60 based on control of the control unit 88. The drive signal is supplied in a constant cycle in synchronization with the transport speed of a print medium P.

The common electrode 24 is formed over substantially the entire surface in a region between the piezoelectric ceramic layer 21*b* and the piezoelectric ceramic layer 21*a*. That is, the common electrode 24 extends so as to cover all the pressurizing chambers 10 in the region facing the piezoelectric actuator substrate 21. The common electrode 24 is connected to the surface electrode 28 for the common electrode at a position avoiding the electrode group consisting of the individual electrodes 44 on the piezoelectric ceramic layer 21*b* through a penetrating conductor formed through the piezoelectric ceramic layer 21*b*. The common electrode 24 is grounded through the surface electrode 28 for the common electrode, and is held at ground potential. The surface electrode 28 for the common electrode is directly or indirectly connected to the control unit 88, similarly to the individual electrode 25.

The portion of the piezoelectric ceramic layer 21*b* sandwiched between the individual electrode 25 and the common electrode 24 is polarized in the thickness direction, and is displaced when a voltage is applied to the individual electrode 25. More specifically, when the individual electrode 25 is set to a potential different from that of the common electrode 24 and an electric field is applied to the piezoelectric ceramic layer 21*b* in the polarization direction, the portion to which the electric field is applied acts as an active part distorted by the piezoelectric effect. In this configuration, when the individual electrode 25 is set to a predetermined positive or negative potential with respect to the common electrode 24 so that the electric field and polarization are in the same direction, a portion (active part) sandwiched by the electrodes of the piezoelectric ceramic layer 21*b* shrinks in the plane direction. On the other hand, since the piezoelectric ceramic layer 21*a* which is a non-active part is not affected by the electric field, the sandwiched portion does not contract spontaneously and tries to regulate deformation of the active part. As a result, a difference in a distortion in the polarization direction occurs between the piezoelectric ceramic layer 21*a* and the piezoelectric ceramic layer 21*b*, and the piezoelectric ceramic layer 21*a* is deformed so as to be convex toward the pressurizing chamber 10 (unimorph deformation).

Subsequently, a discharge operation of liquid will be described. The pressurizing unit 30 is driven (displaced) by the drive signal supplied to the individual electrode 25 based on control of the control unit 88. In this embodiment, although the liquid can be discharged by various driving methods, here, a so-called pull discharge driving method will be described.

The individual electrode 25 is set to a potential (hereinafter, referred to as a high potential) higher than the common electrode 24 in advance, and is set to the same potential (hereinafter, referred to as a low potential) as the common electrode 24 every time discharge is requested, and then is set to the high potential again at predetermined timing. With this configuration, the piezoelectric ceramic layers 21*a* and 21*b* return to the original (flat) shape (at the beginning) at the timing when the individual electrode 25 becomes low potential, and the volume of the pressurizing chamber 10 increases compared to the initial state (the state in which the potentials of both electrodes are different). With this configuration, negative pressure is applied to the liquid in the pressurizing chamber 10. Then, the liquid in the pressurizing chamber 10 starts to vibrate in the natural vibration period. Specifically, at first, the volume of the pressurizing chamber 10 starts to increase, and negative pressure gradually decreases. The volume of the pressurizing chamber 10 then is maximized and the pressure is nearly zero. The volume of the pressurizing chamber 10 then begins to decrease and the pressure becomes higher. Thereafter, the individual electrode 25 is brought to a high potential at the timing when the pressure is almost maximized. Then, vibration applied at first and vibration applied next and greater pressure is applied to the liquid. This pressure propagates in the descender 7 and discharges the liquid from the discharge hole 8.

That is, droplets can be discharged by supplying the individual electrode 25 with a drive signal of a pulse set to low potential for a fixed period based on high potential. Assuming that the pulse width is an acoustic length (AL) which is a half the natural vibration period of the liquid in the pressurizing chamber 10, the discharge speed and the discharge amount of the liquid can be maximized in principle. The natural vibration period of the liquid in the pressurizing chamber 10 is largely influenced by physical property of the liquid and the shape of the pressurizing chamber 10, but in addition, is also influenced by the physical property of the piezoelectric actuator substrate 21 and the characteristic of the flow path connected to the pressurizing chamber 10.

Since there are other factors to consider, such as combining the discharged droplets into one, the pulse width is actually set to a value of about 0.5 AL to 1.5 AL. In addition, since the discharge amount can be reduced by setting the pulse width to a value out of AL, the pulse width is set to the value out of AL in order to reduce the discharge amount.

Next, the configuration and operation of a head control system in the liquid discharge head according to the present disclosure will be described with reference to FIGS. 6 to 10.

Figure 6:
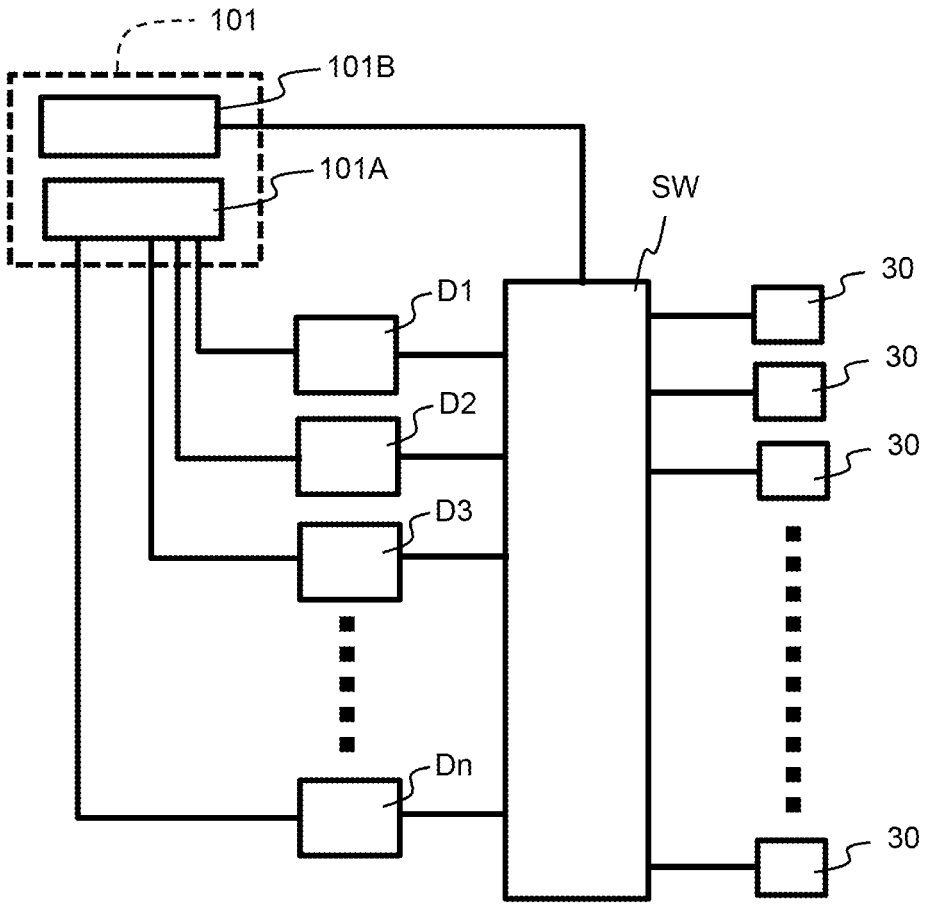
FIG. 6 is a diagram illustrating an example of a configuration of a head control system in the liquid discharge head according to the present disclosure.

FIG. 6 is a diagram illustrating an example of the configuration of the head control system in the liquid discharge head according to the present disclosure. The head control system in the liquid discharge head according to the present disclosure includes a head control unit 101, n drive circuits (a first drive circuit D1, a second drive circuit D2, . . . , an n-th drive circuit Dn) (n is a natural number of 2 or more), and a switch circuit SW. The plurality of pressurizing units 30 is connected to the switch circuit SW.

The head control unit 101 includes at least the first control circuit 101A and a second control circuit 101B. The head control unit 101 may be configured using a field-programmable gate array (FPGA), but in some cases, the head control unit 101 may be configured using another programmable logic device (PLD) or an integrated circuit, or may have another configuration. By configuring the head control unit 101 using an FPGA, the liquid discharge head can be realized at low cost.

The pixel signal output from the control unit 88 described above is input to the head control unit 101 at each drive period at which pixels are formed. The pixel signal is a digital signal indicating the operation of each of the plurality of discharge holes 8. Specifically, the pixel signal is, for example, a signal indicating that droplets forming a pixel of any size on the recording medium are to be discharged by each discharge hole 8.

The first control circuit 101A controls the plurality of drive circuits (D1 to Dn) to output drive signals from the respective drive circuits. The drive signal is an analog signal for driving the pressurizing unit 30, and a plurality of types of drive signals exists according to how the pressurizing unit 30 is driven. For example, corresponding drive signals are sent to the pressurizing units 30 in accordance with discharge of droplets forming a pixel of any size on the recording medium by the respective discharge holes 8. In some cases, a drive signal that causes the pressurizing unit 30 to perform an operation to apply pressure fluctuation to liquid to such an extent that the liquid is not discharged from the discharge hole 8 may be included.

The number of types of drive signals is appropriately set according to, for example, how finely discharge of liquid from each discharge hole 8 is to be controlled. For example, when the discharge of liquid is finely controlled, the type of drive signal is increased. The number of drive circuits (D1 to Dn) is set to a value equal to or larger than the number of types of drive signals. When a drive circuit that does not output a drive signal is disposed or when a drive circuit in which a drive signal to be output changes is disposed according to the situation, the number of drive circuits (D1 to Dn) increases. This will be described in detail later.

When the pixel signal is input to the head control unit 101, the type of necessary drive signal and the number of pressurizing units to which each drive signal is sent are obtained based on the pixel signal. Then, according to that, it is determined which type of drive signal is to be output from which drive circuit. Then, the first control circuit 101A outputs the corresponding drive information signal to each drive circuit according to the drive signal output from each drive circuit. The drive information signal is a signal for outputting the drive signal to each drive circuit, and the same number of drive information signals corresponding to the types of drive signals exist. The drive information signal is, for example, a digital signal having information on voltage change in the corresponding drive signal. The drive information signal may be included in the head control unit 101, or the drive information signal stored in another place may be read. The drive information signal may be included in the head control unit 101, or the drive information signal stored in another place may be read.

Each drive circuit includes, for example, a digital to analog converter (DAC) and an amplification circuit. The DAC converts the input drive information signal into an analog signal. The amplification circuit is configured in multiple stages as necessary, and amplifies and outputs the signal output from the DAC. Thus, each of the plurality of drive circuits (D1 to Dn) outputs the drive signal generated based on the input drive information signal to the switch circuit SW. This configuration is an example, and the configuration of each drive circuit is not limited thereto.

The switch circuit SW is connected to the drive circuit (D1 to Dn) and the plurality of pressurizing units 30, and switches a connection state between the drive circuit (D1 to Dn) and the plurality of pressurizing units 30. In detail, the switch circuit SW connects each of the plurality of pressurizing units 30 to any one of the drive circuits (D1 to Dn). The switch circuit SW can be configured using, for example, a switch IC.

When the pixel signal is input to the head control unit 101, which drive signal is to be input to each of the plurality of pressurizing units 30 is determined, based on the pixel signal. Then, based on which type of drive signal is output from which drive circuit, it is determined which drive circuit is to be connected to each of the plurality of pressurizing units 30, and a connection signal having the information is output from the second control circuit 101B to the switch circuit SW. Then, the switch circuit SW connects each of the plurality of pressurizing units 30 to any one of the drive circuits (D1 to Dn) based on the input connection signal.

Thus, the drive signal is input to each of the plurality of pressurizing units 30 based on the pixel signal output from control unit 88, and the liquid is discharged from the discharge holes 8 corresponding to each pressurizing unit 30, and printing is performed on the recording medium.

Although the example in which the head control unit 101 including the first control circuit 101A and the second control circuit 101B exists is illustrated, but is not limited thereto. For example, the head control unit 101 may not exist, and the first control circuit 101A and the second control circuit 101B may be separated from each other and exist independently, and the pixel signals may be input to each of the first control circuit 101A and the second control circuit 101B. Each of the first control circuit 101A and the second control circuit 101B may be divided into a plurality of parts. The first control circuit 101A and the second control circuit 101B may share at least a part thereof with each other. That is, the first control circuit 101A and the second control circuit 101B may be integrated.

Next, the operation of the head control system in the liquid discharge head according to the present disclosure will be described in more detail using FIGS. 7 and 8.

FIG. 7 is a diagram illustrating an example of rotation of the drive circuits in the liquid discharge head according to the present disclosure. In FIG. 7, the configuration is simplified for ease of description, and a case where three types of drive signals of a first signal S1, a second signal S2 and a third signal S3 are included as the drive signals, and the first drive circuit D1, the second drive circuit D2, a third drive circuit D3, the fourth drive circuit D4, and the fifth drive circuit D5 are included as the drive circuits is illustrated. For example, the first signal S1 is a signal for discharging droplets that form a small size pixel on a recording medium, and the second signal S2 is a signal for discharging droplets that form a medium size pixel on the, recording medium, the third signal S3 is a signal for discharging droplets that form a large size pixel on the recording medium.

The second signal S2 is, for example, a drive signal composed of a pulse having a pulse width of AL, and is a signal for discharging one droplet. The first signal S1 is, for example, a drive signal composed of a pulse having a pulse width of 0.7 AL, and is a signal for discharging one droplet having a smaller volume than the droplet discharged by the second signal S2. The third signal S3 is, for example, a drive signal composed of two pulses with a pulse width of approximately AL, and is a signal that discharges two droplets of approximately the same volume as the droplet discharged by the second signal S2. For the two droplets, the droplet discharged later catches up with the previous droplet during flight to become one droplet, or the two droplets separately land on the recording medium and then spread on the recording medium to form one pixel. For example, the velocities of the two droplets can be made different by making widths of two pulses different. The velocity of the two droplets can be made different by adjusting the interval between two pulses, by using the matters that residual vibration of the liquid remaining in the pressurizing chamber 10 after discharging the previous droplet affects the discharge speed of the next droplet. As described above, the number of droplets is not limited to one, and a plurality of droplets may form one pixel.

In FIG. 7, the term "No output" indicates a drive circuit that does not output a drive signal, and the term "reserve" indicates a drive circuit whose output drive signal changes according to the situation. Further, t1, t2, t3, t4, t5, and t6 indicate time, respectively, and indicate that time goes from t1 to t6.

As illustrated in FIG. 7, in the liquid discharge head according to the present disclosure, for example, the drive circuit that outputs the first signal S1 is the first drive circuit D1 at time t1, but with the lapse of time, the drive circuit is shifted to the second drive circuit D2, the third drive circuit D3, the fourth drive circuit D4, and the fifth drive circuit D5, and becomes the first drive circuit D1 again at time t6. Although not illustrated, the drive circuit is shifted to the second drive circuit D2, the third drive circuit D3, . . . in the same order after time t6. That is, the drive circuit that outputs the first signal S1 is changed among the plurality of drive circuits (D1 to D5). That is, the drive circuit that outputs the first signal S1 is changed among the plurality of drive circuits (D1 to D5) with the lapse of time.

This is realized by the first control circuit 101A changing a destination of the drive information signal corresponding to the first signal S1 with the lapse of time. That is, this is realized by the first control circuit 101A shifting the destination of the drive information signal corresponding to the first signal S1 to the first drive circuit D1, the second drive circuit D2, the third drive circuit D3, the fourth drive circuit D4, the fifth drive circuit D5, the first drive circuit D1, . . . with the lapse of time from time t1.

Similar to the first signal S1, the drive circuit that outputs the second signal S2 is shifted to the fifth drive circuit D5, the first drive circuit D1, the second drive circuit D2, the third drive circuit D3, and the fourth drive circuit D4, and becomes the fifth drive circuit D5 again at time t6, with the lapse of time from time t1. The drive circuit is shifted to the first drive circuit D1, the second drive circuit D2, the third drive circuit D3, . . . in the same order after time t6. Similarly, the drive circuit that outputs the third signal S3 is the drive circuit that outputs the second signal S2 is shifted to the fourth drive circuit D4, the fifth drive circuit D5, the first drive circuit D1, the second drive circuit D2, and the third drive circuit D3, with the lapse of time from time t1.

That is, as described above, when the pixel signal is input to the head control unit 101, which type of drive signal is to be output from which drive circuit is determined based on the pixel signal. The drive signal to be output by each drive circuit is determined such that the drive circuit outputting each drive signal is shifted in the drive circuits (D1 to D5) with the lapse of time. Then, the switch circuit SW connects each of the plurality of pressurizing units 30 to the drive circuit outputting the drive signal to be input (When a plurality of drive circuits outputting the drive signal to be input exists, each pressurizing unit is connected to any one of the drive circuits)

As described above, the liquid discharge head according to the present disclosure includes the plurality of discharge holes 8, the plurality of pressurizing units 30, the plurality of drive circuits (D1 to Dn), the switch circuit SW, and the first control circuit 101A, and the second control circuit 101B. The plurality of pressurizing units 30 pressurizes liquid and discharge the liquid from the discharge hole 8. The plurality of drive circuits (D1 to Dn) outputs drive signals for driving the plurality of pressurizing units 30. The switch circuit SW switches the connection between the plurality of pressurizing units 30 and the plurality of drive circuits (D1 to Dn). The first control circuit 101A controls the plurality of drive circuits (D1 to Dn). The second control circuit 101B controls the switch circuit SW. The liquid discharge head according to the present disclosure discharges includes, as the drive signals, a plurality of types of signals including at least the first signal S1 for discharging droplets forming a pixel of a first size and a second signal S2 for discharging droplets forming a pixel of a second size different from the first size. The first control circuit 101A controls the plurality of drive circuits (D1 to Dn) such that different types of drive signals are output from different drive circuits. The second control circuit 101B controls the switch circuit SW such that each of the plurality of pressurizing units 30 is connected to the drive circuit outputting the first signal S1 when discharging droplets that form the pixel of the first size and is connected to the drive circuit that outputs the second signal S2 when discharging the droplet that forms the pixel of the second size. That is, The second control circuit 101B controls the switch circuit SW such that the pressurizing unit 30 that discharges droplets forming the pixel of the first size is connected to the drive circuit that outputs the first signal S1 and the pressurizing unit 30 that discharges droplets forming the pixel of the second size is connected to the drive circuit that outputs the second signal S2. Then, the first control circuit 101A controls the plurality of drive circuits (D1 to Dn) such that the drive circuit in charge of outputting the first signal S1 is changed among the plurality of drive circuits (D1 to Dn). This is the basic configuration of the liquid discharge head according to the present disclosure.

In the liquid discharge head according to the present disclosure having such a basic configuration, an excessive rise in temperature of a specific drive circuit can be reduced even when the number of pressurizing units 30 to which the first signal S1 is input continues to be large. With this configuration, occurrence of malfunction of the drive circuit due to temperature rise can be reduced. Depending on the disposition of the drive circuits on the liquid discharge head, it is possible to reduce deterioration of the discharge accuracy due to increase of the temperature difference depending on the location of the liquid discharge head. The liquid discharge head according to the present disclosure may have this basic configuration, and the other configuration thereof is not essential and can be changed as appropriate.

In the liquid discharge head according to the present disclosure, the first control circuit 101A can be configured to control the plurality of drive circuits (D1 to Dn) such that the drive circuit in charge of each output of the plurality of types of drive signals (S1 to S3) rotates among the plurality of drive circuits (D1 to Dn) with the lapse of time. When the first control circuit 101A has such a configuration, an excessive rise in temperature of a specific drive circuit can be reduced even when the number of pressurizing units 30 to which any one of the plurality of types of drive signals (S1 to S3) is input continues to be large. The first control circuit 101A may control the plurality of drive circuits such that only a drive circuit outputting a part of drive signals (for example, a drive signal for discharging a pixel of a large size often used when printing a solid pattern) of a plurality of types of drive signals is shifted among the plurality of drive circuits.

As illustrated in FIG. 7, the drive circuit that does not output the drive signal is shifted to the third drive circuit D3, the fourth drive circuit D4, the fifth drive circuit D5, . . . with the lapse of time from time t1. That is, the drive circuit of this example may have a configuration in which the first control circuit 101A controls the plurality of drive circuits (D1 to Dn) such that a part of the plurality of drive circuits (D1 to Dn) does not output the drive signal and the drive circuits that do not output the drive signal are shifted among the plurality of drive circuits (D1 to Dn) with the lapse of time. When the drive circuit has such a configuration, since heat generation of the drive circuit is suppressed while not outputting the drive signal, a significant temperature rise of a specific drive circuit can be reduced.

As illustrated in FIG. 7, there are three types of drive signals of the first signal S1, the second signal S2 and the third signal S3, while five drive circuits of the first circuit D1 to fifth drive circuit D5 are included. That is, the liquid discharge head according to the present disclosure may have a configuration in which the number of drive circuits is larger than the number of types of drive signals. When the liquid discharge head has such a configuration, since it becomes possible to provide a drive circuit which does not output a drive signal or to output one drive signal from a plurality of drive circuits, it is possible to more effectively reduce an excessive temperature rise in a specific drive circuit. In some cases, the number of drive circuits may be the same as the number of drive circuits.

Figure 8:
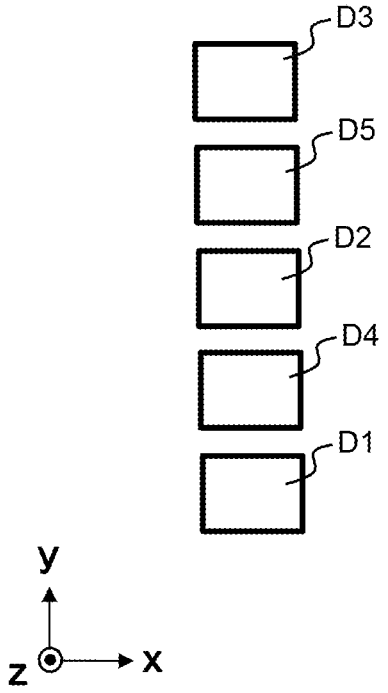
FIG. 8 is a plan view schematically illustrating an example of a disposition of the drive circuits on the liquid discharge head according to the present disclosure.

FIG. 8 is a plan view schematically illustrating an example of the disposition of the drive circuits on the liquid discharge head according to the present disclosure, and in detail, illustrates an example of the disposition of the drive circuits on the liquid discharge head when the drive circuits are rotated as illustrated in FIG. 7. For example, each of the drive circuits (D1 to Dn) is mounted on the head control substrate together with the head control unit 101, and the head control substrate is mounted on the liquid discharge head. Although the switch circuit SW is desirably disposed, for example, on a flexible printed circuit (FPC) that functions as the signal transfer unit 60 described above and is connected to the head control unit 101, the drive circuits (D1 to Dn), and the plurality of pressurizing units 30 through the FPC, in some cases, the switch circuit SW may be mounted on the head control substrate together with the head control unit 101 and the drive circuits (D1 to Dn).

In the example illustrated in FIG. 8, the drive circuits (D1 to D5) are arranged side by side along the +Y direction. In detail, in the +Y direction, the first drive circuit D1, the fourth drive circuit D4, the second drive circuit D2, the fifth drive circuit D5, and the third drive circuit D3 are disposed at equal intervals in this order. In this disposition, pairs of drive circuits closest to each other are four pairs of a pair of the first drive circuit D1 and the fourth drive circuit D4, a pair of fourth drive circuit D4 and the second drive circuit D2, a pair of the second drive circuit D2 and the fifth drive circuit D5, and a pair of the fifth drive circuit D5 and the third drive circuit D3.

In contrast, in the rotation of the drive circuits illustrated in FIG. 7, the drive circuits are arranged in the order of the first drive circuit D1, the second drive circuit D2, the third drive circuit D3, the fourth drive circuit D4, the fifth drive circuit D5, the first drive circuit D1, . . . . Therefore, pairs of drive circuits adjacent to each other in this arrangement are five pairs of a pair of the first drive circuit D1 and the second drive circuit D2, a pair of the second drive circuit D2 and the third drive circuit D3, a pair of the third drive circuit D3 and the fourth drive circuit D4, a pair of the fourth drive circuit D4 and the fifth drive circuit D5, and a pair of the fifth drive circuit D5 and the first drive circuit D1.

Thus, the five pairs adjacent to each other in the disposition in the rotation of the drive circuits illustrated in FIG. 7 and the four pairs closest to each other in the disposition of the drive circuits on the liquid discharge head illustrated in FIG. 8 do not match at all (do not overlap). That is, the drive circuits adjacent to each other in the disposition in the rotation and the drive circuits closest to each other in the disposition on the liquid discharge head are different.

When two drive circuits adjacent to each other in the arrangement in the rotation are disposed close to each other on the liquid discharge head, a problem that the temperature of the drive circuit positioned relatively backward in the disposition in the rotation among the two drive circuits is excessively increased by heat transfer between the two drive circuits may occur. The occurrence of this problem can be reduced by disposing the drive circuits so that the drive circuits adjacent to each other in the disposition in the rotation and the drive circuits closest to each other in the disposition on the liquid discharge head are different.

Figure 9:
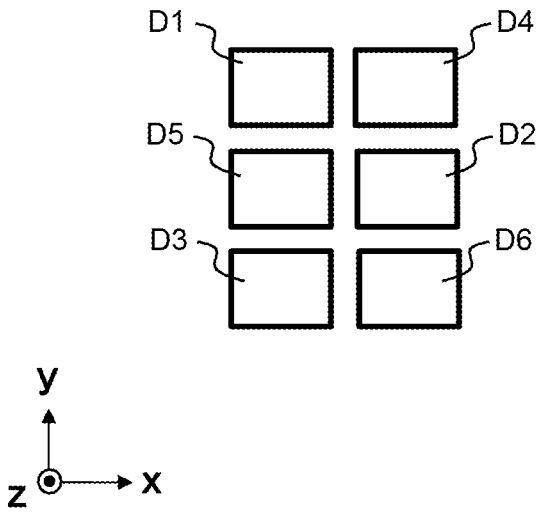
FIG. 9 is a plan view schematically illustrating another example of the disposition of the drive circuits on the liquid discharge head according to the present disclosure.

FIG. 9 is a plan view schematically illustrating another example of the disposition of the drive circuits on the liquid discharge head according to the present disclosure. In detail, FIG. 9 illustrates an example of the disposition of the drive circuits on the liquid discharge head when the six drive circuits of the first drive circuit D1 to the sixth drive circuit D6 are included and the drive circuits are arranged in the order of the first drive circuit D1, the second drive circuit D2, the third drive circuit D3, the fourth drive circuit D4, the fifth drive circuit D5, the sixth drive circuit D6, the first drive circuit D1, . . . in the rotation.

In the example illustrated in FIG. 9, the six drive circuits (D1 to D6) are disposed in alignment along the +X direction and the +Y direction orthogonal to each other, and disposed in two columns in the +X direction and three columns in the +Y direction. In detail, in the first column in the +X direction, the third drive circuit D3, the fifth drive circuit D5, and the first drive circuit D1 are disposed in this order in the +Y direction, and in the second column in the +X direction, the sixth drive circuit D6, the second drive circuit D2, and the fourth drive circuit D4 are disposed in this order in the +Y direction. The intervals between adjacent drive circuits in the +X direction and the intervals between adjacent drive circuits in the +Y direction are all equal. The drive circuits closest to each other in this disposition are seven pairs of drive circuits of a pair of the first drive circuit D1 and the fourth drive circuit D4, a pair of the fourth drive circuit D4 and the second drive circuit D2, a pair of the second drive circuit D2 and the fifth drive circuit D5, a pair of the fifth drive circuit D5 and third drive circuit D3, a pair of the third drive circuit D3 and sixth drive circuit D6, a pair of the sixth drive circuit D6 and the second drive circuit D2, and a pair of the first drive circuit D1 and the fifth drive circuit D5.

In contrast, the drive circuits adjacent to each other in the disposition of the drive circuits in the rotation of the drive circuits are six pairs of a pair of the first drive circuit D1 and the second drive circuit D2, a pair of the second drive circuit D2 and the third drive circuit D3, a pair of the third drive circuit D3 and the fourth drive circuit D4, a pair of the fourth drive circuit D4 and the fifth drive circuit D5, a pair of the fifth drive circuit D5 and the sixth drive circuit D6, and a pair of the sixth drive circuit D6 and the first drive circuit D1.

The six pairs adjacent to each other in the disposition of the drive circuits the in rotation and the seven pairs closest to each other in the disposition of the drive circuits on the liquid discharge head illustrated in FIG. 9 are not equal. That is, the drive circuits adjacent to each other in the disposition in the rotation and the drive circuits closest to each other in the disposition on the liquid discharge head are different. With this configuration, excessive temperature rise in a particular drive circuit can be reduced.

Thus, the liquid discharge head according to the present disclosure may have a configuration in which the drive circuits adjacent to each other in the disposition in the rotation and the drive circuits closest to each other in the disposition on the liquid discharge head are different. When the liquid discharge head has such a configuration, excessive temperature rise in a specific drive circuit can be reduced.

When the drive circuits are disposed on both sides of the substrate and the distance between the drive circuits disposed so as to face each other across the substrate is shortest, the two drive circuits become the drive circuits closest to each other in the disposition on the liquid discharge head.

FIG. 10 is a diagram illustrating an example of the drive signals output at each time in each drive circuit when rotation of the drive circuits illustrated in FIG. 7 is implemented. The term of "No output" in FIG. 10 indicates that no drive signal is output.

As described above, the term of "reserve" in FIG. 7 means a drive circuit whose output drive signal changes according to the situation. For example, the operation of "reserve" can be set in such a way that when the number of pressurizing units 30 connected to the drive circuit that output one drive signal exceeds a reference value determined in advance, the drive signal is output, and otherwise, the drive signal is not output. In the example illustrated in FIG. 10, a case where only the number of pressurizing units 30 connected to the drive circuit outputting the first signal S1 exceeds a predetermined reference value at time t2 and time t3 and only the number of pressurizing units 30 connected to the drive circuit outputting the second signal S2 exceeds the predetermined reference value at time t5 and time t6 is illustrated.

As illustrated in FIG. 7, the drive circuit to be "reserve" is shifted to the second drive circuit D2, the third drive circuit D3, the fourth drive circuit D4, the fifth drive circuit D5, and the first drive circuit D1, the second drive circuit D2, . . . with the lapse of time from time t1. Based on this, referring to FIG. 10, the drive circuit to be "reserve" outputs the first signal S1 at time t2 and time t3, outputs the second signal S2 at time t5 and time t6, and does not output the drive signal at time t1 and time t4.

By the operation of such "reserve", as illustrated in FIG. 10, the second drive circuit D2 and the third drive circuit D3 output the first signal S1 at time t2, the third drive circuit D3 and the fourth drive circuit D4 output the first signal S1 at time t3, the first drive circuit D1 and the fourth drive circuit D4 output the second signal S2 at time t5, and the second drive circuit D2 and the fifth drive circuit D5 output the second signal S2 at time t6.

Thus, the liquid discharge head according to the present disclosure may have a configuration in which the first control circuit 101A controls the plurality of drive circuits (D1 to Dn) such that at least two drive circuits output the same type of drive signal at a certain point in time. When the liquid discharge head has such a configuration, since the load on one drive circuit can be reduced, it is possible to reduce an excessive temperature rise in a specific drive circuit and an increase in temperature difference between the drive circuits.

In the example illustrated in FIG. 10, at time t2 and time t3, the number of pressurizing units 30 connected to the drive circuit that outputs the first signal S1 is larger than the number of pressurizing units 30 connected to the drive circuit that outputs the second signal S2 and the number of driving circuits that output the first signal S1 is larger than the number of driving circuits that output the second signal S2. That is, in the liquid discharge head of this example, at a certain point in time, the number of pressurizing units 30 connected to the drive circuit outputting the first signal S1 larger than the number of pressurizing units 30 connected to the drive circuit outputting the second signal S2 larger and the number of driving circuits that output the first signal S1 is larger than the number of driving circuits that output the second signal S2 (The first control circuit 101A controls a plurality of drive circuits to be so). With this configuration, since it is possible to increase the number of drive circuits that output drive signals having a large number of output destination pressurizing units 30, it is possible to reduce an excessive temperature rise in a specific drive circuit and an increase in temperature difference between the drive circuits.

Next, details of control using such "reserve" will be described. For example, based on the input pixel signal, while allocating each drive signal and the pressurizing unit 30 to the corresponding drive circuit, the number of pressurizing units connected to each drive circuit is counted. When the number of pressurizing units 30 connected to the drive circuit that outputs a certain drive signal (for example, the first signal S1) exceeds the reference value determined in advance, the output of the first signal S1 is allocated to the "reserve", and thereafter, the pressurizing unit 30 that sends the first signal S1 is connected to the "reserve". In this way, control using the "reserve" can be performed.

By including a plurality of "reserves", finer control is possible. Each drive signal may be allocated to the plurality of drive circuits in advance. Instead of counting the number of pressurizing units 30 connected to each drive circuit, the number of output (the number of pressurizing units 30 to which the drive signal is sent) of each drive signal may be counted. In that case, for example, control can be performed in such a way that by providing a plurality of reference values, if the number of outputs of the drive signal exceeds the first reference value the number of outputs of the drive signal is allocated to the first "reserve" thereafter and if the number of outputs of the drive signal exceeds the second reference value, the number of outputs of the drive signal is allocated to the second "reserve" thereafter.

Also, instead of shifting the drive circuit that outputs each drive signal in an order determined in advance, it is also possible to grasp a history of the number of connections of each drive circuit (the number of pressurizing units connected to the drive circuits) and a history of the number of outputs of each drive signal of each drive circuit and to shift the drive circuit that outputs each drive signal accordingly.

For example, it is possible to count the number of connections of each drive circuit and the number of outputs of each drive signal in the past one or a plurality of ejections and allocate the outputs of the drive signal having a small number of outputs to the drive circuit having a large number of connections. For example, the drive circuits can be arranged in the order in which the number of connections is large, and the drive signals can be allocated in the order in which the number of outputs is small.

Even if the drive signals that are output once are the same, for example, power consumption of the drive signal for forming the large pixels on the recording medium is larger than that of the drive signal for forming the small pixels on the recording medium. For that reason, the amount of heat generation accompanying the output of the drive signal for forming the large pixel is larger than the amount of heat generation accompanying the output of the drive signal for forming the small pixel. Therefore, it is also possible to shift the drive circuit in consideration of power consumption of each drive signal or the amount of heat generation accompanying the output of each drive signal.

For example, it is also possible to shift the drive circuit in such a way that the amount of heat generation (or power consumption) of each drive circuit in the past discharge is obtained and the drive signal to be output is exchanged between the drive circuit with the highest amount of heat generation and the drive circuit with the lowest amount of heat generation, the drive signal to be output is exchanged between the drive circuit with the second highest amount of heat generation and the drive circuit with the second lowest amount of heat generation, . . . and so on. A sensor that detects the temperature of each drive circuit may be installed to perform the rotation of the drive circuit based on information from the sensor.

When the drive signals (for example, the first signal S1 and the second signal S2) that approximate each other exist, for example, it is also possible to cancel the output of the drive signal (for example, the first signal S1) with a small number of outputs, to send the second signal S2 from the other drive circuit instead of the first signal S1 to the pressurizing unit 30 to which the first signal S1 should have been sent, and to allocate the output of another drive signal having a large number of outputs to the drive circuit to which the output of the first signal S1 should have been allocated.

Although FIG. 7 illustrates an example in which the drive circuits (D1 to Dn) are connected to one switch circuit SW, when the number of the discharge holes 8 is large, or the like, a plurality of switch circuits SW may be disposed, and each of the plurality of switch circuits SW may be connected to all of the drive circuits (D1 to Dn). For example, when the number of discharge holes 8 is 2400, the number of output terminals of one switch circuit SW is 400, and the number of drive circuits is 16, sixteen drive circuits (D1 to D16) are connected to one head control unit 101, and each of the sixteen drive circuits (D1 to D16) is connected to six switch circuits SW, and four hundred pressurizing units 30 may be connected to each of the six switch circuits SW. If two such configurations are provided, 4800 pressurizing units 30 can be controlled. That is, the pressurizing unit 30 of the liquid discharge head is divided into a plurality of groups, and a plurality of head driving systems as illustrated in FIG. 7 may be disposed, and each head drive system may be in charge of control of the pressurizing units 30 belonging to each group.

Another liquid discharge head according to the present disclosure includes, for example, the plurality of pressurizing units 30, the plurality of drive circuits (D1 to Dn), the switch circuit SW, the first control circuit 101A, and a second control circuit 101B. The plurality of pressurizing units 30 pressurizes liquid and discharge the liquid from the discharge holes 8. The plurality of drive circuits (D1 to Dn) outputs drive signals for driving the plurality of pressurizing units 30. The switch circuit SW switches the connection between the plurality of pressurizing units 30 and the plurality of drive circuits (D1 to Dn). The first control circuit 101A controls the plurality of drive circuits (D1 to Dn). The second control circuit 101B controls the switch circuit SW. The liquid discharge head according to the present disclosure includes, as the drive signals, a plurality of types of signals including at least the first signal S1 for discharging droplets forming a pixel of a first size, and a second signal S2 for discharging droplets forming a pixel of a second size different from the first size. The first control circuit 101A controls the plurality of drive circuits (D1 to Dn) such that different types of drive signals are output from different drive circuits. The second control circuit 101B controls the switch circuit SW such that each of the plurality of pressurizing units 30 is connected to a drive circuit outputting the first signal S1 when discharging droplets forming the pixel of the first size and is connected to a drive circuit outputting the second signal S2 when discharging droplets forming the pixel of the second size. That is, the second control circuit 101B controls the switch circuit SW such that the pressurizing unit 30 that discharges droplets forming the pixel of the first size is connected to the drive circuit that outputs the first signal S1 and the pressurizing unit 30 that discharges the droplets forming the pixel of the second size is connected to the drive circuit that outputs the second signal S2. The first control circuit 101A and the second control circuit 101B are mounted on the FPGA.

For example, in a liquid discharge head in which several thousands of pressurizing units 30 operate at a drive frequency of about 5 to 100 kHz, controlling the plurality of drive circuits (D1 to Dn) such that the drive circuit in charge of outputting the first signal S1 is shifted among the plurality of drive circuits (D1 to Dn) with the lapse of time, by the first control circuit 101A, is difficult in control by a program. However, by mounting the first control circuit 101A and the second control circuit 101B on the FPGA, it is possible to realize a liquid discharge head capable of performing such an operation at low cost.

The liquid discharge head according to the present disclosure is not limited to the specific example described above, and various modifications thereof are possible. A configuration obtained by combining the configurations described in different examples may be adopted.

REFERENCE SIGNS LIST

1 Color ink jet printer
2 Liquid discharge head
2*a* Head main body
3 Flow path member
4*a* to *l* Plate (of flow path member)
4-1 Discharge hole surface
4-2 Pressurizing chamber surface
5 Manifold
5*a* Opening (of manifold)
5*b* Sub-manifold (common flow path)
6 Diaphragm
7 Descender (partial flow path)
8 Discharge hole
9 Discharge hole row
10 Pressurizing chamber
11 Pressurizing chamber row
12 Individual flow path
15 Partition wall
16 Dummy pressurizing chamber
21 Piezoelectric actuator substrate
21*a* Piezoelectric ceramic layer (vibration plate)
21*b* Piezoelectric ceramic layer
24 Common electrode
25 Individual electrode
25*a* Individual electrode main body
25*b* Extraction electrode
26 Connection electrode
28 Surface electrode for common electrode
30 Pressurizing unit
60 Signal transfer unit
70 Head mounting frame
72 Head group
80A Paper feed roller
80B Recovery roller
82A Guide roller
82B Transport roller

88 Control unit
P Printing paper
101 Head control unit
101A First control circuit
101B Second control circuit
D1 to Dn Drive circuit
D1 First drive circuit
D2 Second drive circuit
D3 Third drive circuit
D4 Fourth drive circuit
D5 Fifth drive circuit
D6 Sixth drive circuit
S1 First signal
S2 Second signal
S3 Third signal
SW Switch circuit

The invention claimed is:

1. A liquid discharge head, comprising:

a plurality of discharge holes;

a plurality of pressurizing units that pressurizes liquid and discharges the liquid from the plurality of discharge holes;

a plurality of drive circuits that outputs drive signals for driving the plurality of pressurizing units, the drive signals comprising a plurality of types of signals comprising at least a first signal for discharging a droplet forming a pixel of a first size and a second signal for discharging a droplet forming a pixel of a second size different from the first size;

a switch circuit that switches connection between the plurality of pressurizing units and the plurality of drive circuits;

a first control circuit that controls the plurality of drive circuits to output different types of the drive signals from different drive circuits among the plurality of drive circuits and to cause a drive circuit in charge of outputting the first signal to be changed among the plurality of drive circuits; and a second control circuit that controls the switch circuit to cause each of the plurality of pressurizing units to be connected to the drive circuit in charge of outputting the first signal when the droplet forming the pixel of the first size is discharged and to be connected to a drive circuit in charge of outputting the second signal among the plurality of drive circuits when the droplet forming the pixel of the second size is discharged.

2. The liquid discharge head according to claim 1, wherein the first control circuit controls the plurality of drive circuits to cause drive circuits in charge of outputting a plurality of different types of drive signals to be changed in rotation among the plurality of drive circuits with a lapse of time.

3. The liquid discharge head according to claim 2, wherein drive circuits adjacent to each other in an arrangement in the rotation are different from drive circuits closest to each other in a disposition on the liquid discharge head among the plurality of drive circuits.

4. The liquid discharge head according to claim 1, wherein the number of drive circuits in the plurality of drive circuits is greater than the number of the types of the drive signals.

5. The liquid discharge head according to claim 4, wherein the first control circuit controls the plurality of drive circuits to cause a part of the plurality of drive circuits not to output the drive signals and the part of the plurality of drive circuits that do not output the drive signals to be shifted among the plurality of drive circuits with a lapse of time.

6. The liquid discharge head according to claim 4, wherein the first control circuit controls the plurality of drive circuits to cause at least two of the plurality of drive circuits to output an identical type of the drive signal at a certain point in time.

7. The liquid discharge head according to claim 6, wherein the number of pressurizing units connected to the drive circuits in charge of outputting the first signal is greater than the number of pressurizing units connected to the drive circuits in charge of outputting the second signal among the plurality of pressurizing units, and the number of the drive circuits in charge of outputting the first signal is greater than the number of the drive circuits in charge of outputting the second signal, at a certain point in time.

8. A liquid discharge head, comprising:

a plurality of discharge holes;

a plurality of pressurizing units that pressurizes liquid and discharges the liquid from the plurality of discharge holes;

a plurality of drive circuits that outputs drive signals for driving the plurality of pressurizing units, the drive signals comprising a plurality of types of drive signals comprising at least a first signal for discharging a droplet forming a pixel of a first size and a second signal for discharging a droplet forming a pixel of a second size different from the first size;

a switch circuit that switches connection between the plurality of pressurizing units and the plurality of drive circuits;

a first control circuit, mounted on a field-programmable gate array (FPGA), that controls the plurality of drive circuits to output different types of the drive signals from different drive circuits among the plurality of drive circuits; and a second control circuit, mounted on a FPGA, that controls the switch circuit to cause each of the plurality of pressurizing units to be connected to a drive circuit in charge of outputting the first signal among the plurality of drive circuits when the droplet forming the pixel of the first size is discharged and to be connected to a drive circuit in charge of outputting the second signal among the plurality of drive circuits when the droplet forming the pixel of the second size is discharged.

9. The liquid discharge head according to claim 8, wherein the first control circuit controls the plurality of drive circuits to cause the drive circuit in charge of outputting the first signal to be shifted among the plurality of drive circuits with a lapse of time.

10. The liquid discharge head according to claim 9, wherein the first control circuit controls the plurality of drive circuits to cause drive circuits in charge of outputting a plurality of different types of the drive signals to be changed in rotation among the plurality of drive circuits with a lapse of time.

11. A recording device, comprising:

the liquid discharge head according to claim 1; and a transport unit that transports a recording medium with respect to the liquid discharge head.

* * * * *